US009590344B2

(12) United States Patent
Krishnamoorthy

(10) Patent No.: US 9,590,344 B2
(45) Date of Patent: Mar. 7, 2017

(54) ULTRA LOW PROFILE PCB EMBEDDABLE ELECTRICAL CONNECTOR ASSEMBLIES FOR POWER AND SIGNAL TRANSMISSION

(71) Applicant: HELION CONCEPTS, INC., San Jose, CA (US)

(72) Inventor: Sudarshan Krishnamoorthy, San Jose, CA (US)

(73) Assignee: HELION CONCEPTS, INC., San Jose, CA (US)

( * ) Notice: Subject to any disclaimer, the term of this patent is extended or adjusted under 35 U.S.C. 154(b) by 0 days.

(21) Appl. No.: 14/854,859

(22) Filed: Sep. 15, 2015

(65) Prior Publication Data

US 2016/0079696 A1 Mar. 17, 2016

Related U.S. Application Data

(60) Provisional application No. 62/051,744, filed on Sep. 17, 2014.

(51) Int. Cl.
*H01R 13/20* (2006.01)
*H01R 12/73* (2011.01)
(Continued)

(52) U.S. Cl.
CPC ..... *H01R 13/20* (2013.01); *H01R 12/732* (2013.01); *H01R 12/7082* (2013.01); *H01R 2101/00* (2013.01)

(58) Field of Classification Search
CPC ..... H01R 13/22; H01R 13/20; H01R 13/428; H01R 12/732; H01R 13/7082;
(Continued)

(56) References Cited

U.S. PATENT DOCUMENTS 3,603,915 A * 9/1971 Jayne ..... H01R 12/7005 439/633
4,931,021 A * 6/1990 Mohan ..... G02B 6/3833 439/284
(Continued)

FOREIGN PATENT DOCUMENTS

JP 2001068184 A 3/2001
JP 2003317830 A 7/2003
(Continued)

OTHER PUBLICATIONS

PCT No. US2015/050378, The International Search Report and Written Opinion of the International Searching Authority. 12 Pages. Dated Dec. 23, 2015.

*Primary Examiner* — Abdullah Riyami
*Assistant Examiner* — Harshad Patel
(74) *Attorney, Agent, or Firm* — Seager, Tufte & Wickhem LLP

(57) ABSTRACT

Methods and devices for interconnection of Printed Circuit Boards (PCB) and to one another or to other components using ultra low profile electrical connectors. Examples include male and female inserts for placement in the plane of a PCB, and PCB assemblies comprising one or the other of male or female inserts for such placement. Further examples include surface mounted male and female connectors and PCB assemblies, in which the connectors comprise base members and connector elements configured to couple to corresponding assemblies on other PCT assemblies by movement in a horizontal plane relative to the PCB.

18 Claims, 17 Drawing Sheets

(51) Int. Cl.
*H01R 12/70* (2011.01)
*H01R 101/00* (2006.01)

(58) Field of Classification Search
CPC .... H01R 12/721; H01R 12/722; H05K 1/142; H05K 1/145
USPC 439/329, 330, 65, 66, 79, 82, 81, 381, 636, 439/845, 849, 850, 851, 885
See application file for complete search history.

(56) References Cited

U.S. PATENT DOCUMENTS 4,979,903 A * 12/1990 Gosselin ..... H05K 3/3405 439/78
5,108,295 A * 4/1992 Koike ..... H01R 12/725 439/79
5,411,402 A * 5/1995 Bethurum ..... G06K 19/07743 29/857
6,030,231 A * 2/2000 Sarkiniemi ..... H01R 24/50 439/101
6,062,911 A * 5/2000 Davis ..... H01R 13/2492 439/630
6,102,734 A * 8/2000 Kuo ..... H01R 13/73 439/545
7,320,606 B2 * 1/2008 Midorikawa ..... H01R 12/716 439/660
7,710,740 B2 * 5/2010 Liu ..... H05K 1/147 361/748
7,802,994 B1 * 9/2010 Chen ..... H01R 12/58 439/65
8,272,897 B1 * 9/2012 Lin ..... H01R 12/724 439/607.4
8,282,403 B2 * 10/2012 Sawai ..... H05K 1/117 439/79
8,475,184 B2 * 7/2013 Hasegawa ..... H01R 13/112 439/345
8,727,813 B2 * 5/2014 Yang ..... H01R 12/732 439/500
8,740,642 B2 * 6/2014 Keenihan ..... H01R 31/00 439/510
8,998,660 B2 * 4/2015 Bakos ..... H01R 4/28 439/878
9,095,069 B2 * 7/2015 Stefanoff ..... H05K 1/142
9,136,655 B2 * 9/2015 Moon ..... H01R 12/515
9,166,327 B2 * 10/2015 Yu ..... H01R 13/46
2002/0080590 A1 * 6/2002 Bauermeister ..... H05K 1/142 361/803
2002/0094708 A1 * 7/2002 Budman ..... H01R 12/585 439/82
2006/0067064 A1 3/2006 Crews et al.
2008/0144301 A1 * 6/2008 Konishi ..... H01R 12/58 361/803
2008/0187700 A1 * 8/2008 Smith ..... B05B 13/0285 428/36.5
2008/0318478 A1 * 12/2008 Nelson ..... H05K 1/117 439/620.01
2013/0130534 A1 * 5/2013 Ohkuma ..... H01R 12/7052 439/345
2013/0252472 A1 * 9/2013 Watanabe ..... F21V 23/06 439/638

FOREIGN PATENT DOCUMENTS

KR 20000033782 A 6/2000
KR 20080061779 A 7/2008

* cited by examiner

ULTRA LOW PROFILE PCB EMBEDDABLE ELECTRICAL CONNECTOR ASSEMBLIES FOR POWER AND SIGNAL TRANSMISSION

CROSS REFERENCE TO RELATED APPLICATIONS

The present application claims the benefit of and priority to U.S. Provisional Patent Application No. 62/051,744, titled METHODS OF INTERCONNECTING PRINTED CIRCUIT BOARDS USING ULTRA LOW PROFILE PCB EMBEDDABLE ELECTRICAL CONNECTOR ASSEMBLIES FOR POWER AND SIGNAL TRANSMISSION, filed on Sep. 17, 2014, the disclosure of which is incorporated herein by reference.

TECHNICAL FIELD AND INDUSTRIAL APPLICABILITY

The invention relates to method of interconnection of Printed Circuit Board (PCB) using ultra low profile electrical connectors that can be mounted on to a PCB using drilled holes or using surface mounting techniques, or that can be embedded into the PCBs for transmission of signal and power.

BACKGROUND

Electrical connectors are widely used in the electronics industry for transmitting power and data between semiconductors chips and Printed Circuit Board (PCB). Most of the connectors use a tongue and groove assembly where the female receptacle inside a suitable casing is flexible and stretches to accommodate a male connector part to maximize contact area and secure the male contact such that a reasonable force is required to separate the male and female connector to prevent accidental disconnection.

With rapid miniaturization of printed circuit boards and semiconductor chips, there has been a drive for miniaturization of the electrical connectors that are placed on the printed circuit board with either a through hole configuration or are surface mounted on the PCB to transfer electrical power or signals from metal conductors on the PCB to the outside world and vice-a-versa or between PCBs. Most of the concentration on miniaturization of the electrical connector has been on reducing the lateral dimensions of the electrical connectors along the plane of the PCB surface, to minimize its footprint on the surface of the PCB, rather than on the miniaturization of the thickness of the connectors in the direction of the thickness of the PCB. New and alternative designs are needed that allow for thinning of connectors to the limits of material strength. Such thinning would allow for embedding connectors inside PCBs freeing up space on top of the PCB for other components and circuits and streamlining design of PCBs.

DETAILED SPECIFICATION

The following detailed description should be read with reference to the drawings. The drawings, which are not necessarily to scale, depict illustrative embodiments and are not intended to limit the scope of the invention.

Most of the concentration on miniaturization of the electrical connector has been on reducing the lateral dimensions of electrical connectors along the plane of the PCB surface, to minimize its footprint on the surface of the PCB, rather than on the miniaturization of the thickness of the connectors along the direction of the thickness of the PCB. This means that the expansion of the connector assembly's female receptacle, to accept its male counterpart, happens in the direction perpendicular to the plane of the PCB. This is mostly favorable for dense digital circuits having a large number of signals that need to the transmitted between the PCBs. But this approach also limits the minimum thickness of the connectors that can be achieved as the connector height which is perpendicular to the plane of the PCB has to accommodate the metal thickness of the male connector part, the thickness of the metal receptacle in the female connector and the expansion of the female receptacle to accommodate the male part. The metal thickness is usually a function of the amount of current density it need to carry, which is usually large for a dense digital circuit.

The Inventor has recognized that the power supply lines on a PCB (as opposed to signal or data lines) are far fewer and transmission of power between PCBs can be accomplished with much thinner connector assemblies where the female connector can expand along the plane of the PCB. Depending on the requirements of the current density and correspondingly the contact area between the male and the female connectors, the width of the connector metal arms can be made larger to accommodate much larger current densities in an example seen in power electronic, analog and mixed signal circuits. Methods of manufacture and assembly of such connectors and integration onto a PCB is shown in this invention. While such improvements may be directed toward power supply lines, these connectors may also be used for digital or analog data or signal lines.

Figure 1:
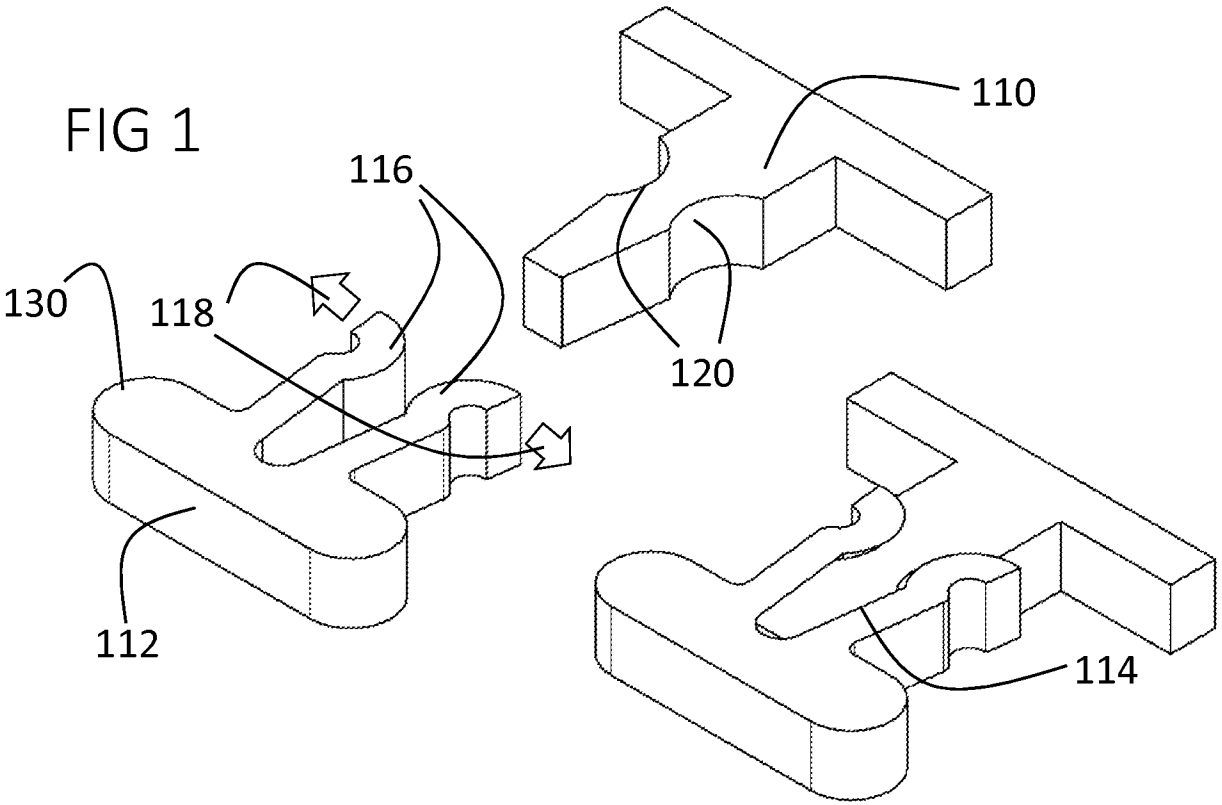
FIG. 1 shows the geometry of the male and female connector components and the coupled assembly of these parts for an illustrative example.

FIG. 1 shows the geometry of an illustrative male connector 110 and female receptacle connector 112 designed to form maximum contact area 114. The female connectors 112 can be manufactured with high strength spring tempered material like Beryllium Copper, Phosphor Bronze, or other conductive materials with resilient spring properties. The connectors designed to expand in the direction shown in 118 when the male connector is inserted into the female connector with reasonable force. The displacement or expansion of the female connector is designed to be along the plane of the PCB which allows dramatic reduction in the thickness of the connectors and the final connector assembly in the direction of thickness of the PCB. The connectors may be formed by stamping, cutting or otherwise shaping the metal connectors which may also be annealed or plated, for example. 3D printing can be used as well. Additional details, features, and/or other manufacturing processes are noted below as well.

The illustrative female connector has a notch 116 on the far end away from the base of the connector that snaps into the detent 120 on the male connector. This mechanism not only secures the connection but also provides a tactile feedback and an audible click to ensure the user that a proper connection has been made between the male and female connector. In the illustration, the male connector has the detent 120 and the female connector has the notch 116; in another example the male connector may have the notch, while the female connector has the detent.

The shapes and dimensions of the connectors can be varied to accommodate different current carrying requirements of the connectors. Keeping the thickness constant the dimension along the plane of the PCB can be varied to adjust the contact surface area to suit any given current density requirement. In an illustrative example, the top and/or bottom side of the female connectors may be covered with a stiff material so as to prevent the male connector from disengaging from the female connection in the direction perpendicular to the plane of the top and bottom surface of the connectors. This can be accomplished either by sheathing the connectors in an appropriate casing and/or by soldering or gluing stiff metal or insulating plates on the top and bottom side of the connector assembly, as will be described below.

Figure 2:
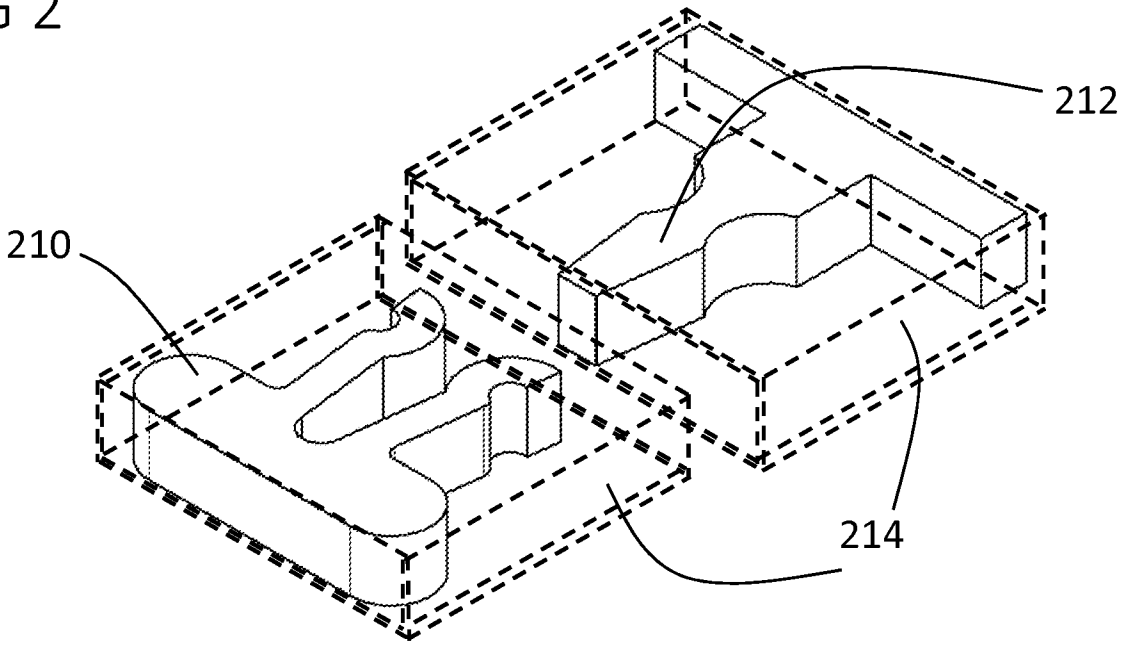
FIG. 2 shows the detached male and female connectors enclosed inside a casing made of insulating material for an illustrative example.

FIG. 2 shows illustrative male 212 and female connectors 210 encased by insulating boxes 214 for placement on top of the PCB or in line with a PCB. The insulating material can be appropriately chosen based on current, voltage and temperature requirements. The top side of the insulating box is shown as transparent to enable visualization of the metal connectors enclosed therein but need not necessarily be transparent. Illustrative materials for the boxes 214 include, for example, silicon rubber and other suitable insulators. The boxes 214 may be generally hollow and provide space for movement of the arms of the female connector 210 within or parallel to the plane of the PCB.

Figure 3:
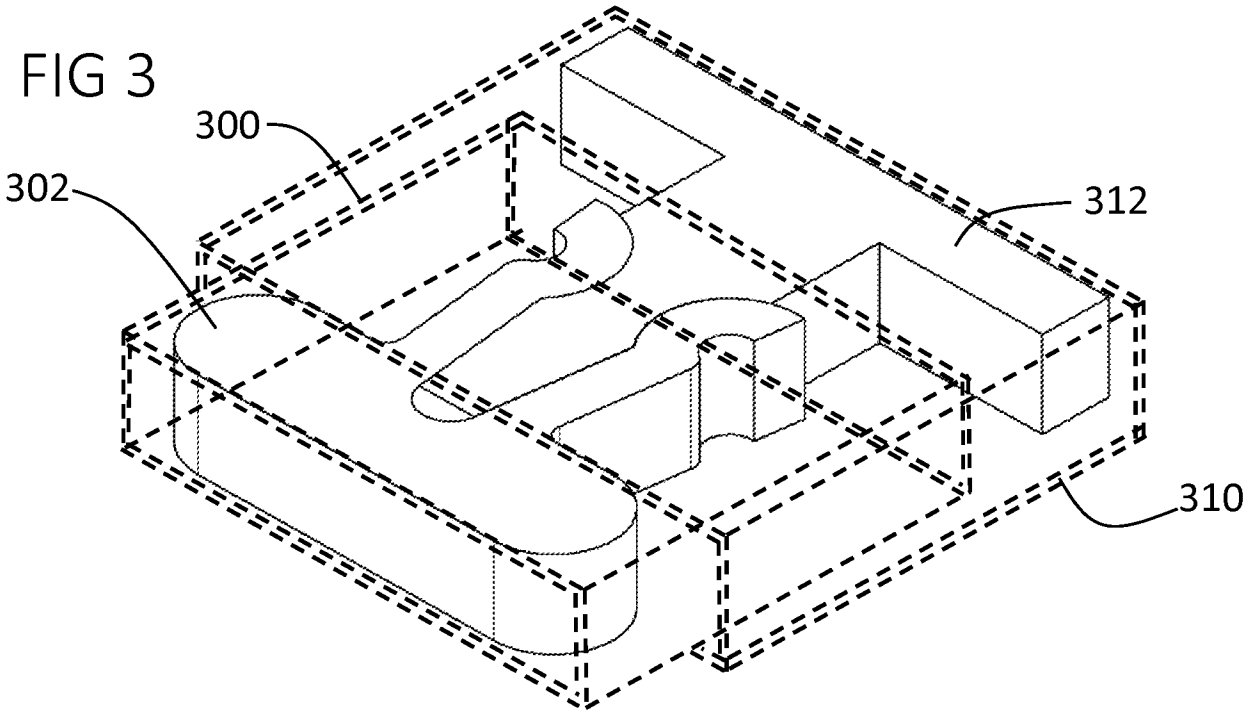
FIG. 3 shows the coupled male and female connectors enclosed inside a casing made of insulating material for an illustrative example.
Figure 4:
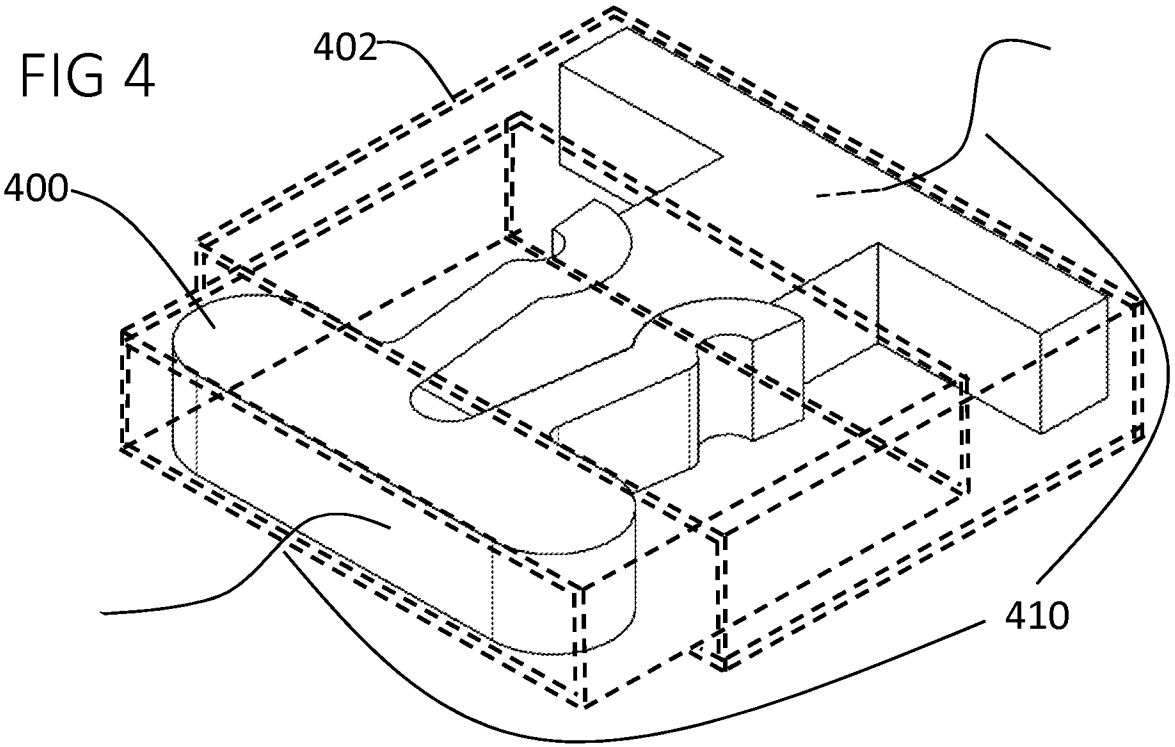
FIG. 4 shows a coupled male and female connector assembly enclosed inside an insulating casing with wires soldered to the conductors forming a standalone connector assembly for an illustrative example.

FIG. 3 shows the interconnection of an encased 300 female connector 302 with an encased 310 male connector 312. Once fully coupled as shown, ingress of water, dirt or the like can be prevented by the encasing structures 300, 310. Encasing connectors 400, 402 in an insulating casing allows them to be used as a standalone connectors by attaching wires 410 to the metal connectors as shown in FIG. 4. This enables the transmission of power and data signals to the external world.

Figure 5:
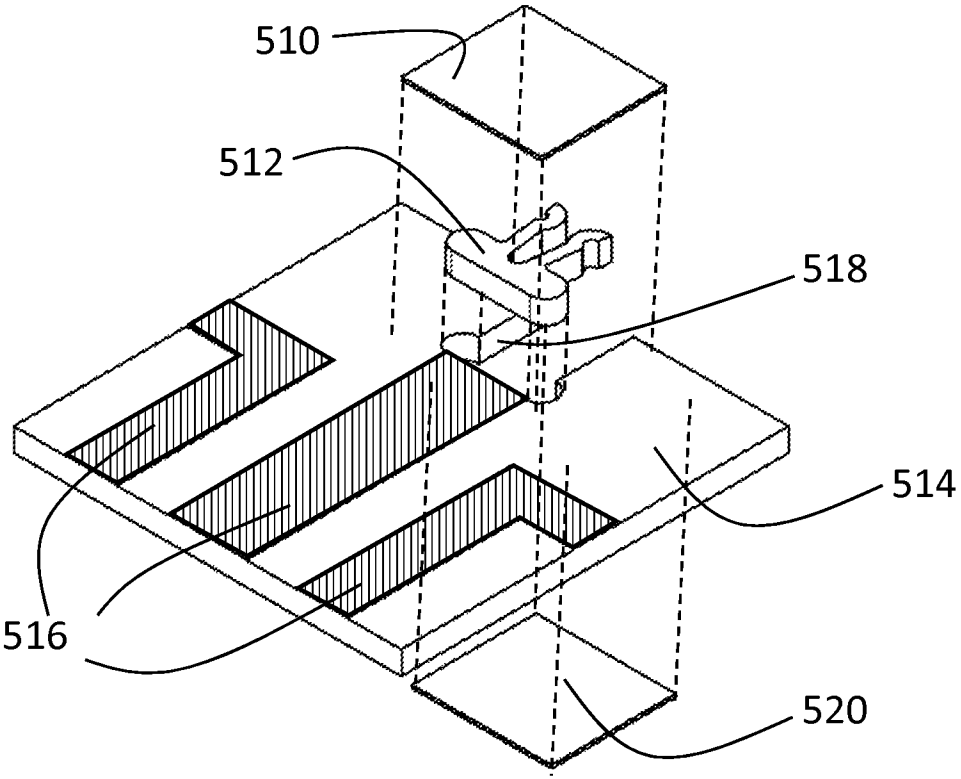
FIG. 5 shows the process of embedding the low profile female receptacle connector into the PCB for an illustrative example.

In an illustrative example the connectors shown and described herein are embedded into the PCB itself. For example, as shown in FIG. 5, the PCB 514 having traces 516 for carrying electrical power, signals or data, an appropriate slot 518 can be milled, etched or laser cut out of the PCB. Next the female connector 512 is dropped into place in line with the PCB. The formed slot may be plated or insulated, as desired. For a multi-layer PCB, the appropriate layer for a conductive trace 516 can extend all the way to the slot 518, where it may be plated if desired, to facilitate conductive coupling to the female connector 512 or male connector (FIG. 6) if desired. Other conductive layers of the PCB may have a pull-back region around the slot 518. The connector 512 may have the same or lesser thickness as the PCB 514 in some examples, allowing the connector 512 to sit flush in the milled opening 518.

It may be noted that the slot 518 can be sized and shaped as shown with a first region of greater width for securing the female connector and a second region of narrower width, to provide pull strength extending out of the PCB in the plane of the PCB. To this end, and referring again to FIG. 1, the female connector 112 is shown having a foot at 130 that is wider than the rest of the female connector 112 to assist in mechanical fixation. The narrower portion of slot 518 (FIG. 5) is wider than the space needed by the arms 118 (FIG. 1) to allow the arms to flex outward when a male connector is inserted therein. The use of such a "foot" is optional. The connector may be further secured in placed by hammering or applying adhesive. In another example, in order to prevent accidental disengagement of the male connector in the direction perpendicular to the plane of the PCB, stiff metal or insulating plates may be soldered or glued on top 510 and bottom sides 520 of the PCB over the region of the slot 518.

Figure 6:
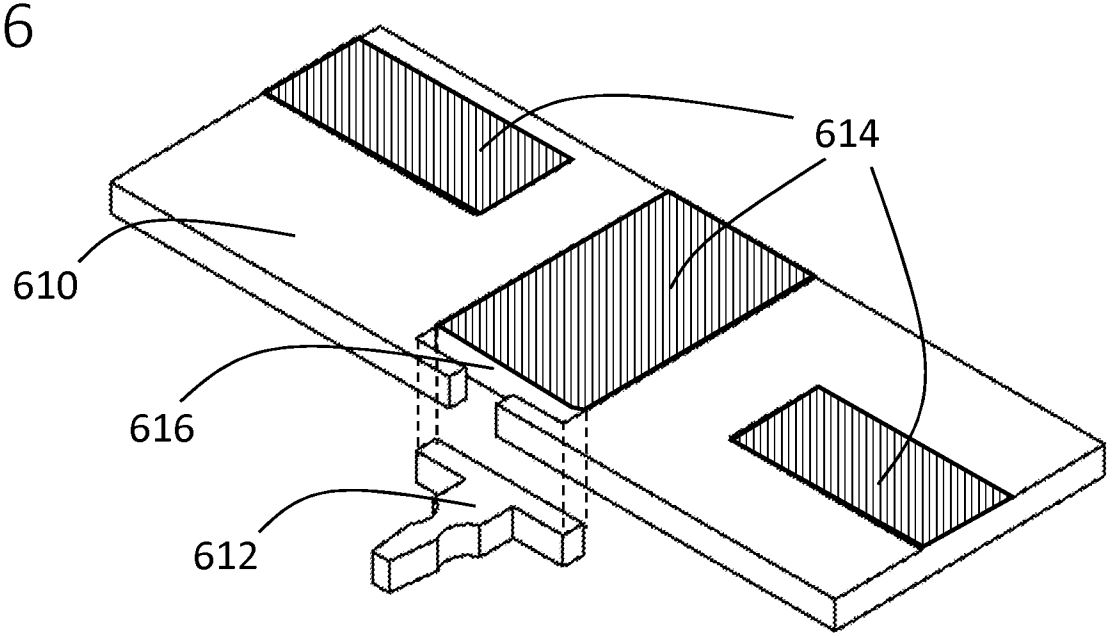
FIG. 6 shows the process of embedding the low profile male connector into the PCB for an illustrative example.

FIG. 6 shows an illustrative step of placing a male connector in line with the plane of a PCB 610. An appropriately sized and shaped slot 616 can be milled, etched or laser cut, for example, in the PCB and plated if desired. The male connector can then be pressed and/or glued into place in connection with a trace 614. As with the female connector (FIG. 5), the male connector 612 is shown having a foot portion that provides mechanical engagement with the edge of the PCB 610. If desired the similar top and bottom plates may be provided as before (FIG. 5 at 510, 520), though these are not required. For additional strength, the PCB 610 (or 514 in FIG. 5) may be reinforced along one or more edges by providing a metal or other stiffener, for example.

Figure 7:
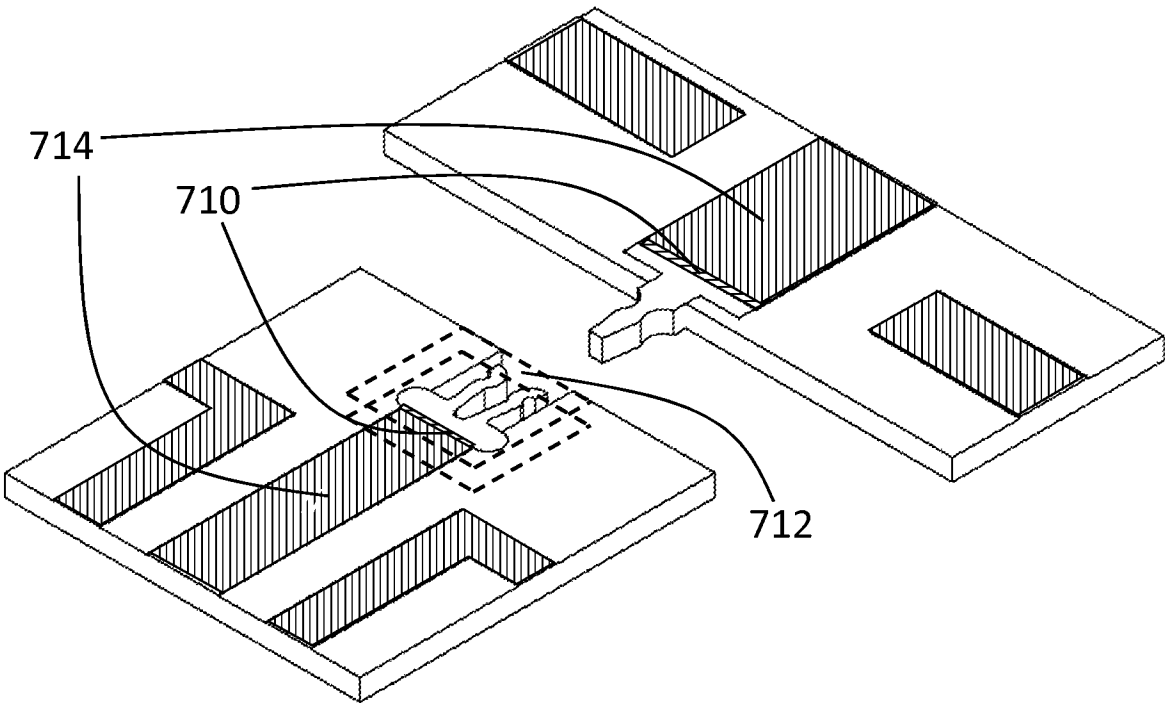
FIG. 7 shows the completed assembly of male and female connectors embedded into the PCB ready to be connected to each other for an illustrative example.
Figure 8:
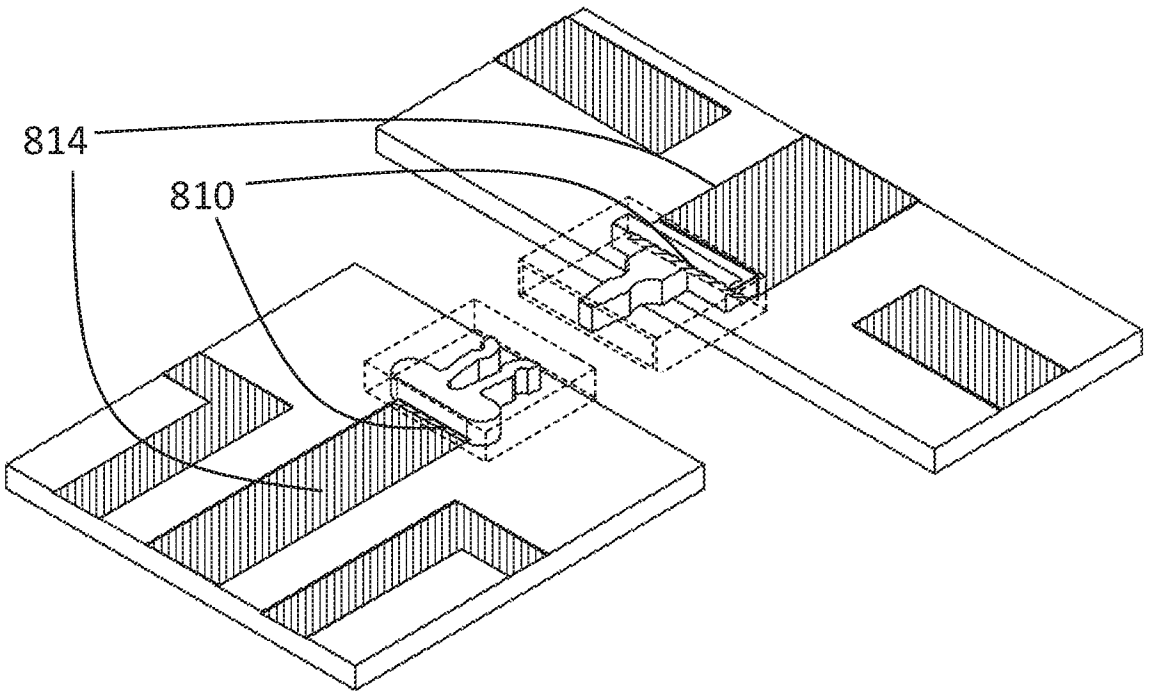
FIG. 8 shows yet another embodiment of connecting the low profile connectors to the PCB using surface mounting techniques (SMT) for an illustrative example.

FIG. 7 shows the completed assembly of the male and female connectors into the PCB. The connection of the female and male connectors to the metal traces 714 on the PCB in an example with solder can be seen in 710. The top metal or insulating plate 712 placed on top of the female connector is shown as transparent to enable visualization of the embedded connectors but is not necessarily so. The low profile connectors can alternatively be soldered on top of the PCBs using traditional surface mounting techniques (SMT) and processes. This is shown in FIG. 8. The solder attachment of the connectors to the metal traces 814 is shown in 810. An enclosure 814 may be included to prevent accidental disengagement of male and female connectors in the direction perpendicular to the plane of the PCB.

Figure 9:
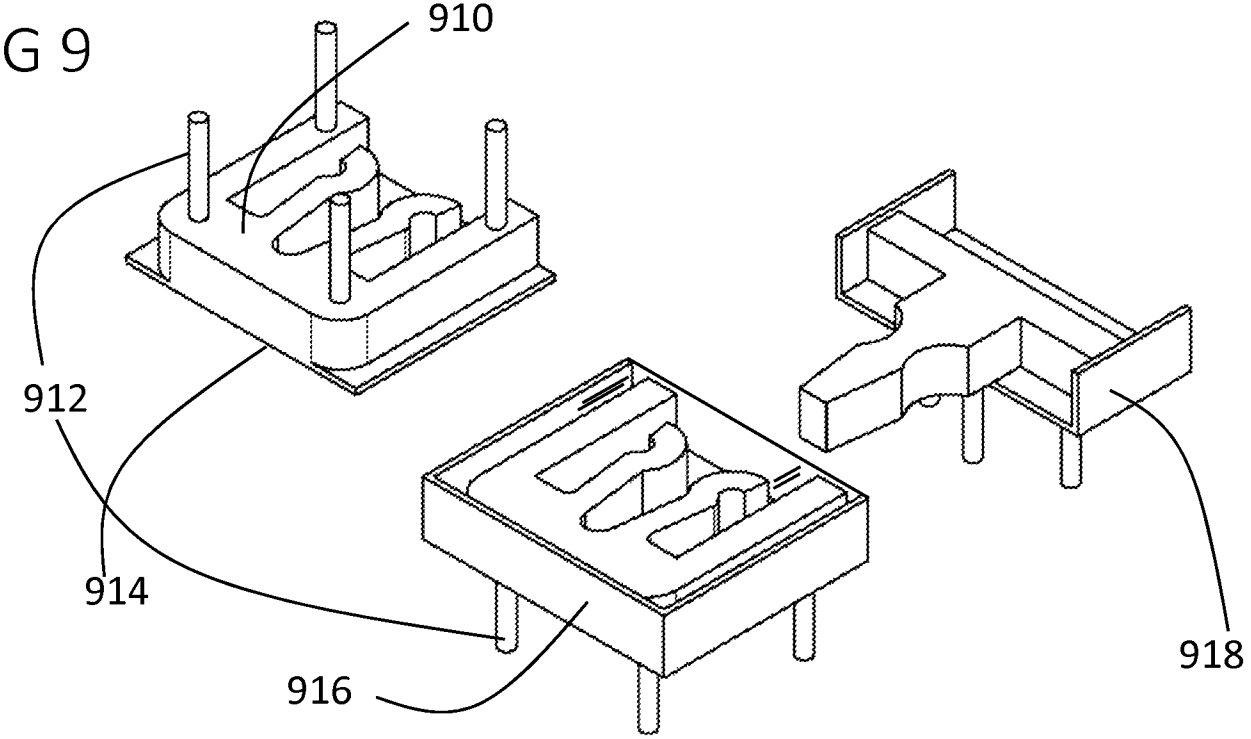
FIG. 9 shows yet another embodiment for the female and male connector with pins attached for insertion into PCB with drilled holes for an illustrative example.

Yet another embodiment of the low profile male and female connectors is shown in FIG. 9 with side arms 910 in an insulating casing for the female connector, with pins 912 extending therefrom. This design enables integration of the connector assembly on a more traditional PCB design where components are placed in drilled holes to be soldered to metal traces manually or with wave soldering techniques. Views 914 and 916 show the bottom side and the top side view respectively of the female connector with casing and pins and 918 shows the male connector inside its casing with pins attached. Some portions of the casing have been shown as transparent to enable better visualization of the connector geometry but are not necessarily so.

Figure 10:
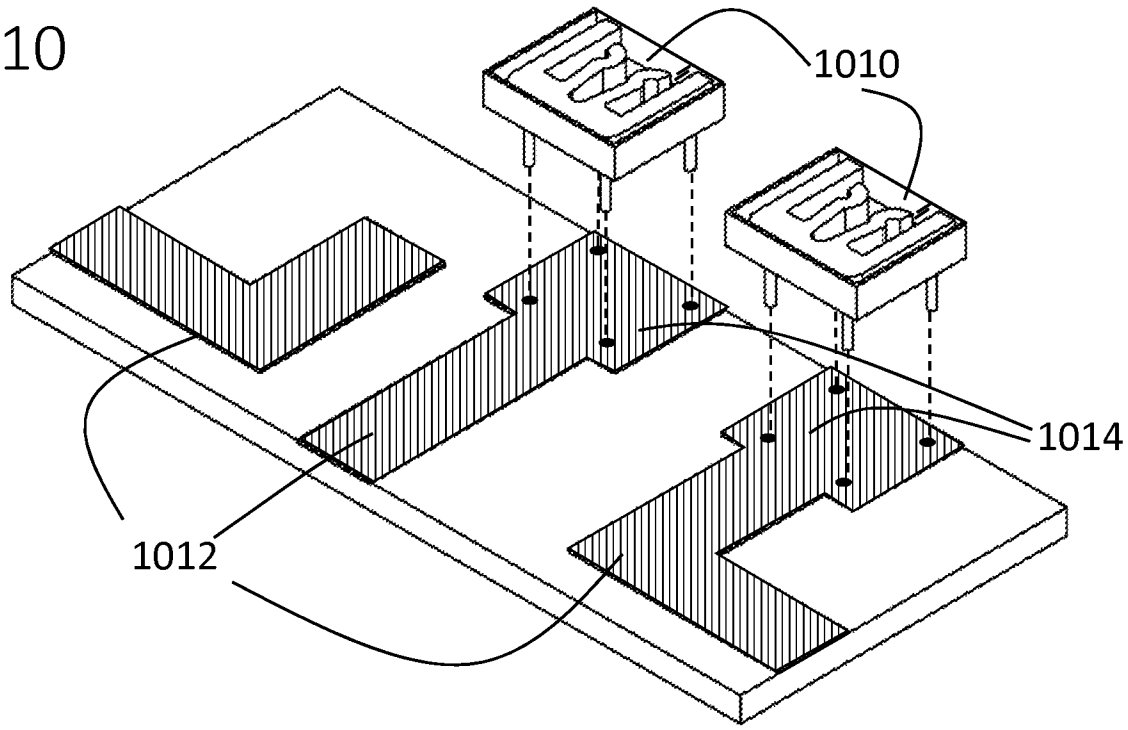
FIG. 10 shows the process of attachment of two adjacently placed female connectors with pins to PCBs with drilled holes for an illustrative example.

FIG. 10 shows the process of attachment of two adjacently placed female connectors with pins 1010. The connectors 1010 are placed on termination pads having drilled holes 1014 connected to end of metal traces 1012 of the PCB to accept these connectors with pins. The metal traces 1012 are illustratively shown on the surface of the PCB but it should be understood that traces 1012 may be on different layers of the PCB and would typically be covered by an insulating layer using common practices in the art. The through holes 1014 may be plated if desired.

Figure 11:
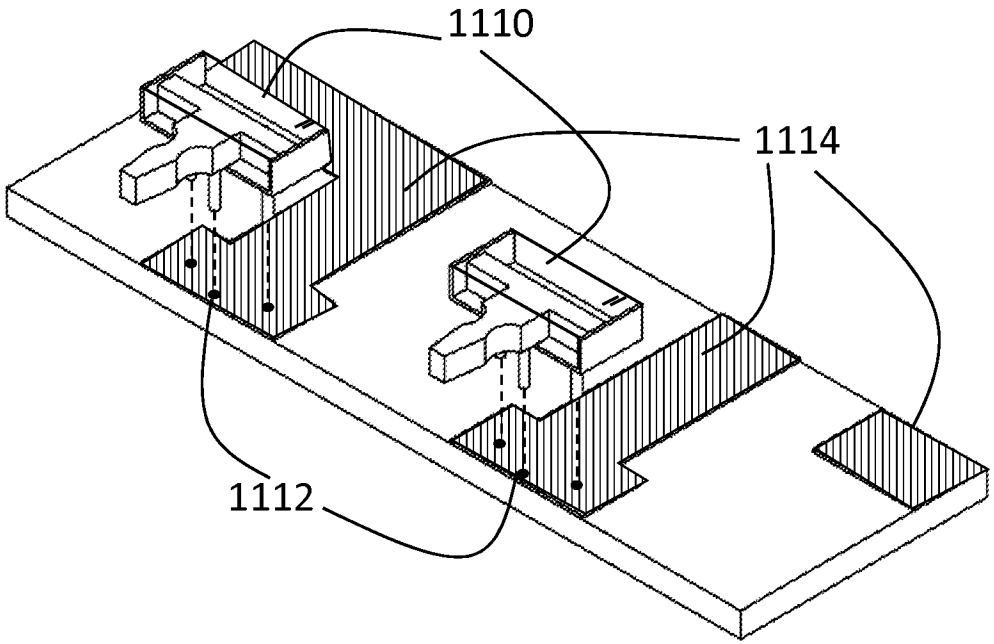
FIG. 11 shows the process of attachment of two adjacently placed male connectors with pins to PCBs with drilled holes for an illustrative example.
Figure 12:
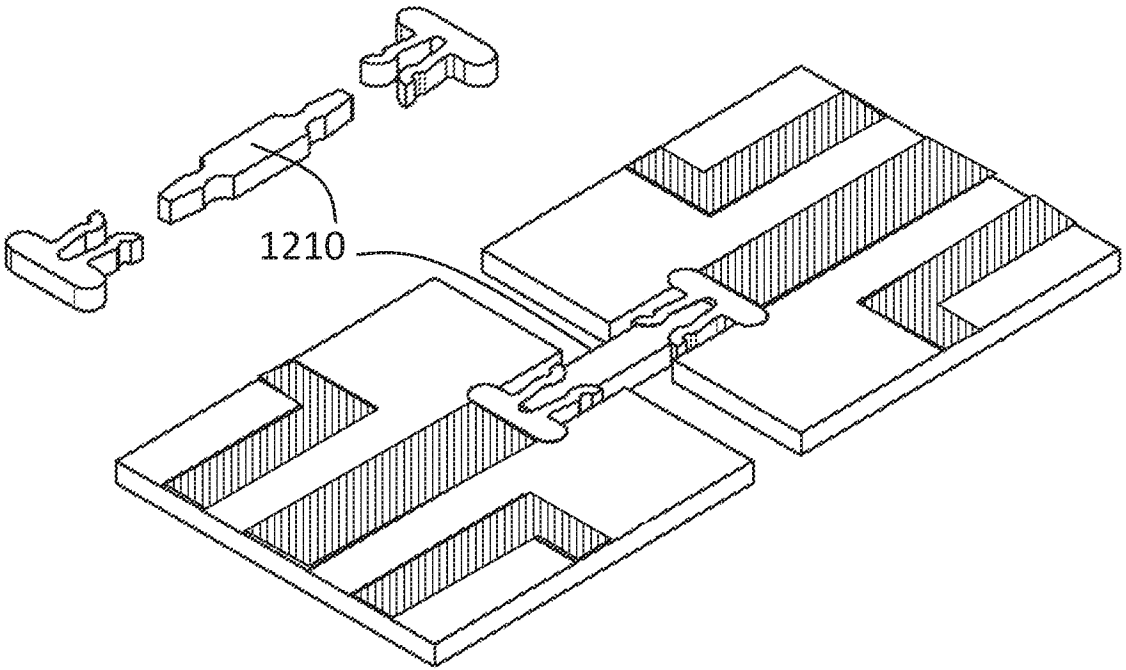
FIG. 12 depicts yet another embodiment of the method of interconnection between two or more PCBs using a double ended male connector to connect two female connectors embedded into the PCBs for an illustrative example.

FIG. 11 shows a similar process of attachment of male connectors with pins 1110 to the termination pads with drilled holes 1112 on the PCBs at the end of metal traces 1114. In yet another embodiment of the method of interconnection between multiple PCBs, two female connectors 1220 can be embedded into the PCB 1230 and be connected by a double ended male connector 1210 to form electrical contact between two PCBs. This kind of contact allows for greater flexibility in interconnection as a single male connector can be easily removed and inserted in different combination of female connectors to make different kinds of electrical connections. Also as only female connectors are embedded into the PCBs the manufacturing aspects can be streamlined and made more cost effective as well. For example, a pick and place process for manufacturing would be more streamlined as there would be no need to specific separate male and female connector parts. Finally, the use of all female connectors may make handling easier as there would be less concern about damaging the male connectors that extend out from the edge of the PCB.

Figure 13:
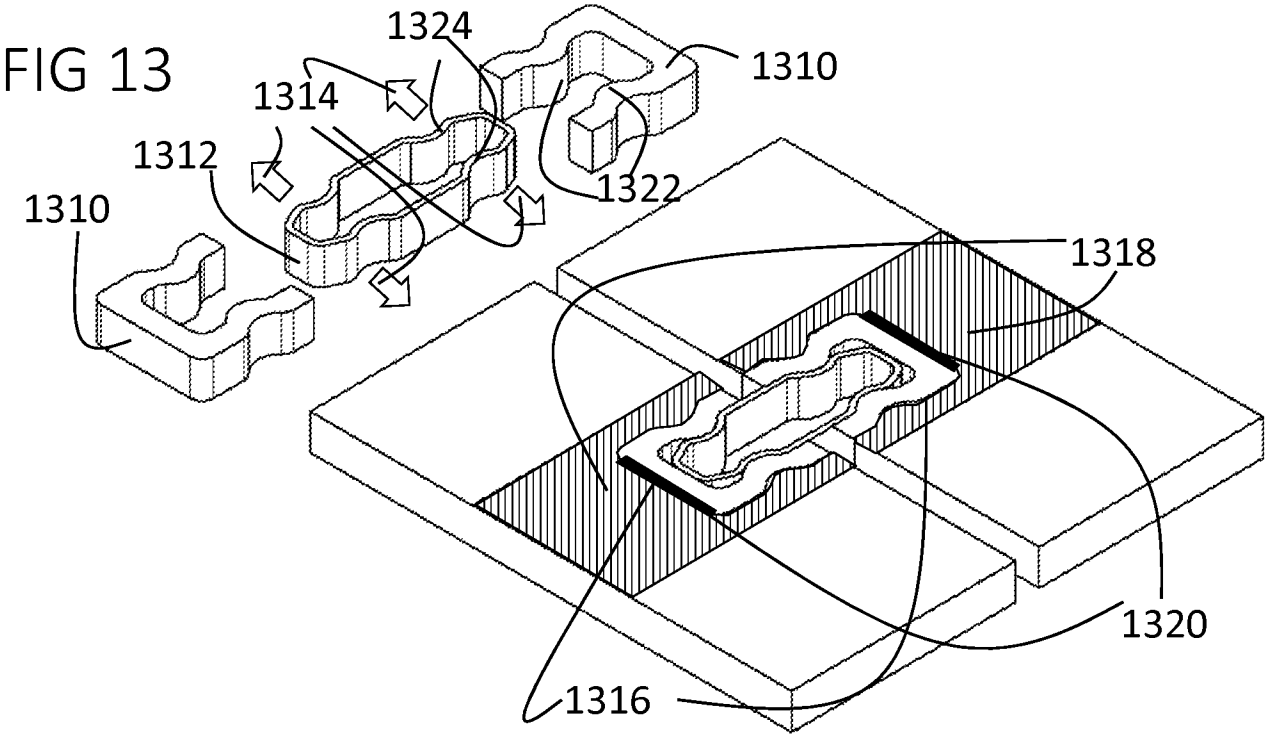
FIG. 13 shows yet another embodiment of two female connectors are connected by a double sided male connector, where the female connector is rigid in shape and the male connector can flex to facilitate insertion into its female counterparts.

FIG. 13 shows a system and method of interconnection between two female connectors with a male interconnector. In this example, the female connectors 1310 are rigid and not flexible and the male connectors 1312 can compress and de-compress along the plane of the PCB 1314. The rigid female connectors can be embedded into a PCB by milling an appropriate slot 1316 and connections to the conductive traces 1318 can be made by soldering the female connectors 1310 at edges 1320. This alternative shape of female connector also has a dimple or a protrusion 1322. The male connector 1312 has a corresponding indentation 1324. This facilitates a secure connection with the spring action of the male connector 1312 when inserted in the female connectors 1310. The spring action in one example also produces an audible click indicating that a connection has been securely made. Another embodiment includes both a flexible female connector as shown above in FIG. 1, for example, and a flexible male connector part as in FIG. 13.

Figure 14:
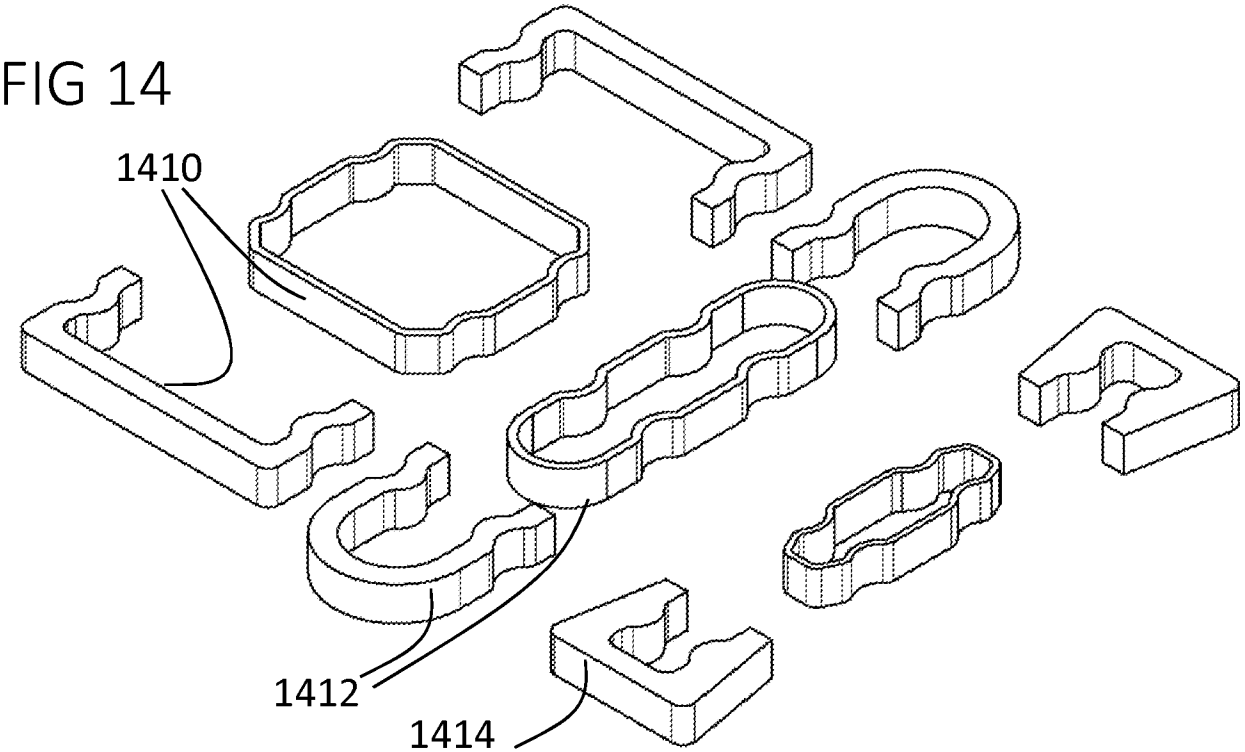
FIG. 14 gives examples of various shapes, contours and sizes of the female and male connectors.

FIG. 14 illustrates that the female and the corresponding male connector can be varied in size 1410 or the shape in various ways. For example, a relatively wider but square base version is shown at 1410, which would sit in a rectangular cut-out of a PCB. The connector at 1412 may sit in a semicircular or rounded cut-out of a PCB. Finally, the connector shown at 1414 can sit in a trapezoidal shaped cut-out. The walls of the connectors also need not be of uniform width. In some instances a wider base such as in shape 1414 and smaller opening can help a secure the connectors inside a PCB better, resisting breakage from the PCB in the event of a pull of the male connector.

Figure 15:
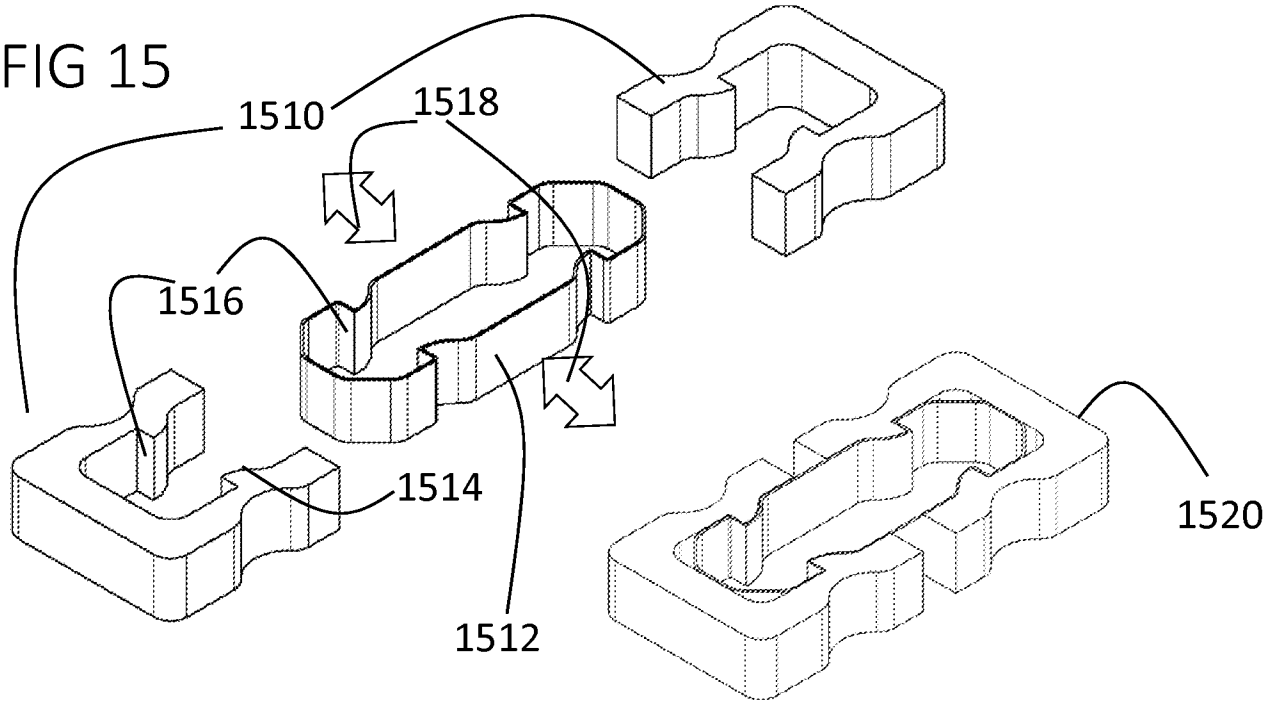
FIG. 15 depicts another embodiment of the male and female coupling connector with specialized groves to enable a secure connection.

Whereas previous embodiments showed the male and female connectors that allowed for easy insertion and removal of the parts by pulling on the connectors, FIG. 15 illustrates an embodiment of the rigid female connector 1510 and a flexible male inter-connector 1512 where a rounded groove 1514 on the female connector 1510 allows for easy insertion of the male connector 1512, but a flattened groove 1516 prevents easy removal of the male connector 1512, thus establishing a secure connection. Since the male connector is flexible, compression along the plane of the PCB 1518 would be necessary to release the connectors. A coupled assembly of two female connectors coupled securely with a male connector is shown at 1520.

Figure 16:
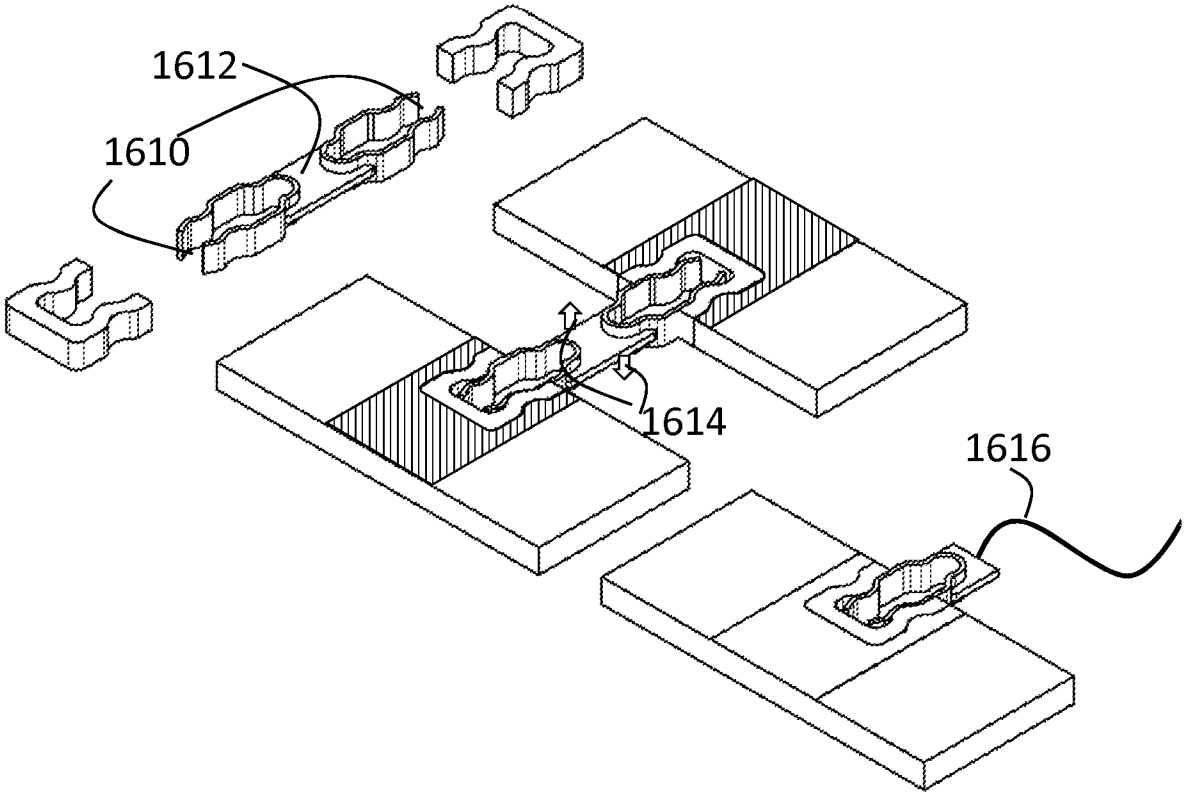
FIG. 16 shows yet another embodiment of the male connector with an opening on the front to facilitate greater flexibility in the male connector during insertion into female connector to establish an electrical connection.

Depending on the springiness of the male connectors it might be helpful or useful to open the male connectors 1612 in the end that is adapted for insertion, as shown in FIG. 16. For example, open ends are shown at 1610 for the illustrative two-way male coupler 1612. This clip type design of the male connector would still flex in the plane of the PCB and securely fit inside the female counterpart connector using matching rounded protrusions and indentations.

Also shown in FIG. 16, rather than a one-piece assembly as shown above, the male connectors can be assembled of one or more clips and a conductor at shown at 1614. The advantage of this embodiment is that the male connector itself becomes flexible in the direction perpendicular to the plane of the connectors and PCBs they would connect. This type of male connector can also be terminated easily into a flexible wire for connection to external circuits, as shown at 1616.

Figure 17:
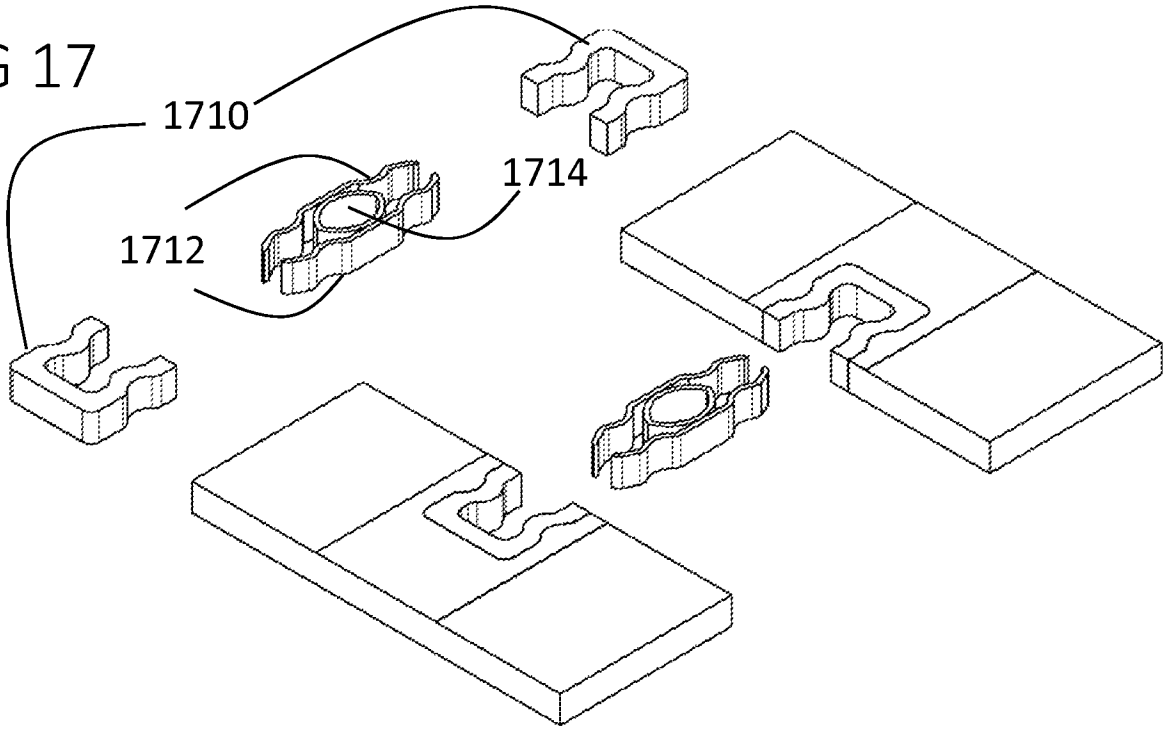
FIG. 17 shows another illustrative example.

FIG. 17 shows another illustrative embodiment. This is again a design having a female connector 1710 on each of two PCBs. An interconnect therebetween is provided using two stiff connectors 1712 having indentations therein are connected to each other using a spring element 1714.

A first non-limiting example takes the form of an insert configured as a female receptacle for an electrical connector to be placed in a slot on a printed circuit board (PCB), the PCB having a horizontal dimension and a vertical dimension, the insert comprising first and second arms connected to a base element, the base element having a width for placement in the horizontal dimension of the PCB, wherein the first and second arms are configured for spring flexing within the horizontal dimension of the PCB. A second non-limiting example takes the form of an insert as in the first non-limiting example, wherein at least one of the first and second arms comprises a detent for releasably securing a male counterpart connector. A third non-limiting example takes the form of an insert as in the first non-limiting example, wherein at least one of the first and second arms comprises a notch for releasably securing a male counterpart connector.

A fourth non-limiting example takes the form of an insert configured as a male coupler for an electrical connector to be placed in a slot on a printed circuit board (PCB) the PCB having a horizontal dimension and a vertical dimension, the insert comprising a base element connected to a protrusion, the base element having a width for placement in the horizontal dimension of the PCB. A fifth non-limiting example takes the form of an insert as in the fourth non-limiting example, wherein the protrusion comprises a notch for releasably securing a female counterpart connector, wherein the notch has an outward face in the direction of the width of the base element. A sixth non-limiting example takes the form of an insert as in the fourth non-limiting example, wherein the protrusion comprises a detent for releasably securing a female counterpart connector, wherein the detent has an outward face in the direction of the width of the base element.

A seventh non-limiting example takes the form of a PCB assembly comprising a PCB having one or more electronic traces thereon and having a horizontal dimension and a vertical dimension; and an insert as in any of the first to sixth non-limiting examples, wherein the PCB includes a milled slot into which the insert is placed. As an alternative, the slot may be laser removed, etched out, stamped or otherwise removed, instead of milled. An eighth non-limiting example takes the form of a PCB assembly as in the seventh non-limiting example further comprising at least a first shield element placed over the insert on the PCB. A ninth non-limiting example takes the form of a PCB assembly as in either of the seventh or eighth non-limiting examples wherein the insert is dimension to sit flush within the milled slot of the PCB. A tenth non-limiting example takes the form of a PCB assembly as in any of the seventh to ninth non-limiting examples wherein the assembly is formed by gluing the insert into place in the milled slot of the PCB. An eleventh non-limiting example takes the form of an insert as in any of the first to sixth non-limiting examples, wherein the base has a width in the range of about 5 to 20 millimeters, and a height in the range of about 5 to 20 millimeters/mils.

A twelfth non-limiting example takes the form of a surface mountable connector (SMC) configured as a female receptacle for an electrical connector for placement on a printed circuit board (PCB) the PCB having a horizontal dimension and a vertical dimension, such that the SMC is to be placed on the surface of the PCB in the vertical dimension thereof, the SMC comprising first and second arms connected to a base element, the base element having a width for placement along the horizontal dimension of the PCB, wherein the first and second arms are configured for spring flexing within the horizontal dimension of the PCB.

A thirteenth non-limiting example takes the form of an SMC as in the twelfth non-limiting example, wherein at least one of the first and second arms comprises a detent for releasably securing a male counterpart connector. A fourteenth non-limiting example takes the form of an SMC as in the twelfth non-limiting example, wherein at least one of the first and second arms comprises a notch for releasably securing a male counterpart connector.

A fifteenth non-limiting example takes the form of a surface mountable connector (SMC) configured as a male coupler for an electrical connector for placement on a printed circuit board (PCB) the PCB having a horizontal dimension and a vertical dimension, the SMC comprising a base element connected to a protrusion, the base element having a width for placement in the horizontal dimension of the PCB.

A sixteenth non-limiting example takes the form of an SMC as in the fifteenth non-limiting example, wherein the protrusion comprises a notch for releasably securing a female counterpart connector, wherein the notch has an outward face in the direction of the width of the base element. A seventeenth non-limiting example takes the form of an SMC as in the fifteenth non-limiting example, wherein the protrusion comprises a detent for releasably securing a female counterpart connector, wherein the detent has an outward face in the direction of the width of the base element.

An eighteenth non-limiting example takes the form of a PCB assembly comprising a PCB having one or more electronic traces thereon and having a horizontal dimension and a vertical dimension; and an SMC as recited in any of the twelfth to seventeenth non-limiting examples, wherein at least one electronic trace is coupled to the SMC. A nineteenth non-limiting example takes the form of an SMC as in any of the twelfth to seventeenth non-limiting examples wherein the base has a width in the range of about 5 to 20 millimeters, and a height in the range of about 5 to 20 millimeters. A twentieth non-limiting example takes the form of a system for creating electrical connections between a first printed circuit board (PCB) and a second PCB, comprising an insert as in the first non-limiting example for use with the first PCB and an insert as in the fourth non-limiting example for use with the second PCB. A twenty-first non-limiting example takes the form of a system for creating electrical connections between a first printed circuit board (PCB) and a second PCB, comprising an SMC as in the twelfth non-limiting example for use with the first PCB and an SMC as in the fifteenth non-limiting example for use with the second PCB.

In an example, the male and female connectors are provided as inserts to be placed flush with a PCB, and may have a thickness to match the thickness of the PCB, for example, in the range of about 1 to 10 mm. The male connector may be in the range of about 6 to 10 mm in length. In an example where the male connector has the detent, the maximum width of the detent may be in the range of about 1 to 5 mm compared to a width elsewhere along the male connector of about 6 to 10 mm. In an example where the male connector has the notch, the minimum width of the notch may be in the range of about 2 to 5 mm compared to a width elsewhere along the male connector of about 6 to 20 mm.

In an example, the male and female connectors takes the form of an SMC as in any of the twelfth to seventeenth non-limiting examples may have a thickness, for example, in the range of about 1 to 10 mm. The male connector may be in the range of about 6 to 20 mm in length. In an example where the male connector has the detent, the maximum width of the detent may be in the range of about 1 to 5 mm, compared to a width elsewhere along the male connector of about 6 to 20 mm. In an example where the male connector has the notch, the minimum width of the notch may be in the range of about 2 to 5 mm compared to a width elsewhere along the male connector of about 6 to 20 mm.

In an example, the male and female connectors are provided as inserts to be placed flush with a PCB, and may have a thickness to match the thickness of the PCB, for example, a thickness of 1.6 mm. The male connector may be in the range of about 7 mm in length. In an example where the male connector has the detent, the maximum width of the detent may be in the range of about 1 mm, compared to a width elsewhere along the male connector of 7 mm. In an example where the male connector has the notch, the minimum width of the notch is about 2 mm compared to a width elsewhere along the male connector of 7 mm. Other sizes and ranges are contemplated for other examples or embodiments.

Several of the above embodiments refer to a PCB. If desired, these concepts may also be applied to flexible circuit boards (flex circuits). The ranges provided are merely illustrative, and larger or smaller dimensions are envisioned in additional or alternative embodiments.

Those skilled in the art will recognize that the present invention may be manifested in a variety of forms other than the specific embodiments described and contemplated herein. Accordingly, departures in form and detail may be made without departing from the scope of the present invention.

The invention claimed is:

1. A printed circuit board (PCB) assembly comprising:

a PCB having one or more electronic traces thereon and having a thickness, a horizontal dimension and a vertical dimension and a slot milled, cut or etched into an edge of the PCB, the slot having a width; and an insert configured as a female receptacle for an electrical connector to be placed in the slot on the PCB, the insert comprising first and second arms connected to a base element, the base element sized and shaped to fit in the slot, and having a width for placement in the width of the slot, wherein the first and second arms are configured for spring flexing within a horizontal direction defined by the width of the slot, wherein the arms are configured to engage and releasably secure a male counterpart connector.

2. The PCB assembly of claim 1 wherein at least one of the first and second arms comprises a detent for releasably securing a male counterpart connector.

3. The PCB assembly of claim 1 wherein at least one of the first and second arms comprises a notch for releasably securing a male counterpart connector.

4. The PCB assembly of claim 1 wherein the base has a width in the range of about 5 to 20 millimeters, and a height in the range of about 5 to 20 millimeters.

5. The PCB assembly of claim 1 wherein the PCB has a thickness and the insert has a thickness which is the same as or less than the PCB thickness.

6. The PCB assembly of claim 1 further comprising a first plate placed over the insert on the PCB, and a second plate placed under the insert on the PCB.

7. The PCB assembly of claim 6 wherein the insert is dimensioned to sit flush within the slot of the PCB.

8. The PCB assembly of claim 1 wherein the assembly comprises glue placed to secure the insert into place in the slot of the PCB.

9. The PCB assembly of claim 1 wherein the insert is dimensioned to sit flush within the slot of the PCB.

10. The PCB assembly of claim 1 wherein the insert has a base with a width in the range of about 5 to 20 millimeters, and a height in the range of about 5 to 20 millimeters.

11. The PCB assembly of claim 1 wherein the slot is trapezoidal and the base and arms are configured to fit in a trapezoidal slot on the edge of the PCB, such that the base is wider than the arms.

12. The PCB assembly of claim 1 wherein the slot is square and the base and arms are configured to fit in a square slot on the edge of the PCB, such that the base and arms have the same width.

13. The PCB assembly of claim 1 wherein the slot is semicircular and the base has a rounded shape, with the arms extending therefrom in a straight direction, such that the insert is configured to sit in the semicircular slot.

14. A printed circuit board (PCB) assembly comprising:

a PCB having one or more electronic traces thereon and having a thickness, a horizontal dimension and a vertical dimension and a slot milled, cut or etched into an edge of the PCB; and an insert configured as a male coupler for an electrical connector to be placed in the slot on the edge of the PCB, the insert comprising a base element connected to a protrusion, the base element having a width for placement in the width of the slot, the protrusion adapted to releasably secure a female counterpart connector.

15. The PCB assembly of claim 14 wherein the protrusion comprises a notch for releasably securing a female counterpart connector, wherein the notch has an outward face in the direction of the width of the base element.

16. The PCB assembly of claim 14 wherein the protrusion comprises a detent for releasably securing a female counterpart connector, wherein the detent has an outward face in the direction of the width of the base element.

17. The PCB assembly of claim 14 wherein the base has a width in the range of about 5 to 20 millimeters, and a height in the range of about 5 to 20 millimeters.

18. The PCB assembly of claim 14 wherein the PCB has a thickness and the insert has a thickness which is the same as or less than the PCB thickness.

* * * * *